US006082469A

United States Patent [19]

Kromray, Jr.

[11] Patent Number: 6,082,469

[45] Date of Patent: Jul. 4, 2000

[54] DOWELING HOLE DRILLING MACHINE

[76] Inventor: Paul Kromray, Jr., 870 Kromray Rd., Lemont, Ill. 60439

[21] Appl. No.: 09/144,320

[22] Filed: Aug. 31, 1998

Related U.S. Application Data

[63] Continuation of application No. 08/512,966, Aug. 9, 1995, Pat. No. 5,799,738.

[51] Int. Cl.[7] ..... E21B 7/02

[52] U.S. Cl. ..... 173/184; 173/28; 173/44; 173/189; 173/190; 173/193

[58] Field of Search ..... 173/28, 184, 185, 173/186, 39, 42, 190, 191, 192, 193, 194, 195, 196, 44, 189

[56] References Cited

U.S. PATENT DOCUMENTS

| | | | |
|---|---|---|---|
| 3,447,613 | 6/1969 | Lisenby | 173/195 |
| 4,225,186 | 9/1980 | Stratton | 173/193 |
| 4,589,499 | 5/1986 | Behrens et al. | 173/184 |
| 4,813,499 | 3/1989 | McNulty | 173/185 |
| 4,858,700 | 8/1989 | Shafer | 173/185 |
| 4,890,680 | 1/1990 | Porsfeld | 173/42 |
| 4,915,180 | 4/1990 | Schisler | 173/44 |

*Primary Examiner*—Scott A. Smith
*Attorney, Agent, or Firm*—Robert L. Marsh

[57] ABSTRACT

A doweling hole drilling machine includes a vehicle such as a tractor having a frame pivotally mounted to the side of the tractor. The frame is moveable around an axis parallel to the longitudinal axis of the vehicle from a first horizontal orientation to a second vertical orientation, and the raising or lowering of the frame is powered by hydraulic cylinders. Positioned on the frame are a plurality of parallel mounted spaced drilling machines, each of which is positioned for drilling a hole perpendicular to the longitudinal axis of the vehicle. Each of the drilling machines is mounted on a drive assembly for moving the machine axially to thereby force a drill bit in the machine to drill a hole. The frame is also laterally adjustable in a horizontal direction perpendicular to the longitudinal axis of the tractor and the lateral adjustment is also hydraulically powered. In a second embodiment, the invention further includes a longitudinal adjustment for moving the frame forward or backward parallel to the longitudinal axis of the tractor.

20 Claims, 10 Drawing Sheets

DOWELING HOLE DRILLING MACHINE

This is a continuation in part of my application filed Aug. 9, 1995, as Ser. No. 08/512,966, now U.S. Pat. No. 5,799, 738.

The present invention relates to a machine for drilling doweling holes in concrete pavement for joining freshly poured concrete to an edge of previously existing concrete paving, and in particular, to a machine for drilling doweling holes in an extended length of pavement.

BACKGROUND OF THE INVENTION

In constructing a concrete road, after the road bed has been established, a first strip of concrete is poured which defines one lane of traffic for the road and typically has a width of about 12 feet. After the first strip of concrete is poured, a second strip is poured parallel to the first, and the second strip of concrete defines a second line of traffic. The process is repeated until the entire width of the road is completed. Each of the successive strips of concrete paving is joined to the preceding strip of pavement by a plurality of metal dowels, one end of which is inserted into bores drilled into the side of the slab of existing pavement and retained therein by epoxy or grout, and the other end of which is surrounded by the fresh concrete of the new pavement. Curbs, gutters and shoulders are also joined to the pavement with dowels.

The specification for concrete roadways generally require that the dowels be spaced twenty four or thirty inches apart. When a concrete roadway is patched by removing a portion of the slab and a replacement patch is poured, the specification generally require that dowels be spaced twelve inches apart along the edges of the patch.

To receive the dowels for attaching a new layer of pavement to an existing layer, holes must be drilled into the sides of the slab of the existing layer for receiving one end of the doweling rods. Two types of drilling machines are available which are capable of drilling such holes, one of which is hydraulically operated, and the other of which is pneumatically operated. Both drilling machines operate by rotating a drill bit into concrete while simultaneously axially hammering the drill bit into the hole. Both types of drilling machines also inject compressed air through a hollow drill to blow cuttings out of the hole being drilled. Currently, hydraulically operated machines are preferred over pneumatically operated machined because the pneumatically operated machines hammer with such a strong impact that damage is caused to the concrete. To operate effectively, the machines must be securely retained over the hole, and the machine must be axially moved toward the surface of the concrete as the hole is bored.

Several devices are available for retaining a plurality of parallel, spaced drilling machines oriented to drill into the side of a concrete slab. One of the most commonly used device has a skid for retaining four or five drilling machines and is manufactured by Woodings Doweling Technologies, Inc. of Mars, Pa. The controls for this device are mounted on the skid, and the skid is adapted to attach to the working end of a backhoe, which is in turn mounted on a tractor.

To operate the device, the tractor to which the backhoe is attached is positioned such that its direction of movement is perpendicular to the side of the pavement into which doweling holes are to be bored. The arm of the backhoe is then maneuvered to position the skid against the side of the concrete pavement with the drilling machines oriented to drill into the pavement side. Compressed air to blow cuttings out of the holes being drilled is received from an air compressor mounted on a second vehicle. One hole is drilled for each of the drilling machines, after which the backhoe must be rotated, and the skid repositioned to drill a second set of holes adjacent to the first set. Eventually, the backhoe with the device attached will drill properly spaced holes along the portion of the pavement which is reachable by the arm of the backhoe, a distance of perhaps 30 feet or more. Thereafter, the tractor and backhoe and associated air compressor must be repositioned near another length of roadway, and the process is repeated.

To operate such equipment, an operator is required to maneuver the vehicle and backhoe arm and a laborer is required to position the drilling machines and operate the controls for the drilling operation. The drilling process can be carried out by positioning the tractor and backhoe assembly off the concrete slab and on the adjacent grade with the drill machines extending away from the tractor or, alternately, by positioning the tractor on the slab with the backhoe arm extending beyond the edge of the slab and the drilling device oriented to drill towards the tractor. Generally, the tractor carrying the device is more easily maneuvered on the concrete slab than it is on the adjacent grade and, therefore, whenever possible, drilling is carried out with the tractor positioned on the slab. It is also desirable to drill the holes into relatively fresh concrete, that is, concrete which has not been fully cured, a process which requires several days.

Fresh concrete is softer than fully cured concrete and, therefore, the drilling process will be less time consuming, and the drill bits used in the process will have a longer useful life. On the other hand, fresh concrete cannot bear the same load that cured concrete can bear, and the specifications for building roads typically prohibit the use of vehicles in excess of 8,000 pounds on fresh concrete poured within the preceding 24 hours. A doweling hole drilling machine which is mounted on a backhoe typically has a weight in excess of 8,000 and usually cannot be used on fresh concrete.

Another type of machine used for drilling doweling holes has a frame with a plurality of drilling machines mounted thereon, and the frame is positioned between pairs of wheels such that it is movable like a vehicle. Such machines are manufactured by Minnich Maginnis Company of Mansfield, Ohio. These machines are relatively light weight and can be used on fresh concrete. The operation of existing wheel mounted doweling hole drilling machines requires that the vehicle be carefully positioned relative to the edge of the concrete in order that the ends of all the drilling machines abut against the side of a slab before the drilling commences. To drill a second set of holes adjacent to a first set of holes, the machine is repositioned by first moving it away from the concrete slab so that the machine will not scrape against the side of the concrete as it is moved to the next drilling location. Existing wheel mounted doweling hole drilling machines are pneumatically operated and a second vehicle having an air compressor thereon must accompany the machine to provide compressed air. These devices again require two operators. It would be desirable to provide a dowel hole drilling machine which could be operated by a single operator and which would overcome the problems of existing dowel hole drilling machines.

SUMMARY OF THE INVENTION

Briefly, the present invention is embodied in a doweling hole drilling machine which includes a vehicle such as a tractor having a frame pivotally mounted to the side of the tractor. The frame is moveable around an axis parallel to the longitudinal axis of the vehicle from a first horizontal orientation to a second vertical orientation, and the raising or lowering of the frame is powered by hydraulic cylinders. Positioned on the frame are a plurality of parallel mounted spaced drilling machines, each of which is positioned for drilling a hole perpendicular to the longitudinal axis of the vehicle. Each of the drilling machines is mounted on a drive assembly for moving the machine axially to thereby force a drill bit in the machine to drill a hole.

The frame is also laterally adjustable in a horizontal direction perpendicular to the longitudinal axis of the tractor so that the frame and drilling machines may be moved against the side of a concrete slab without moving the tractor, and the lateral adjustment is also hydraulically powered.

In a second embodiment, the invention further includes a longitudinal adjustment for moving the frame forward or backward parallel to the longitudinal axis of the tractor, a feature which is desirable for drilling on twelve inch centers. Like the lateral adjustment in the preferred embodiment, the longitudinal adjustment is also hydraulically powered.

GENERAL DESCRIPTION OF THE DRAWINGS

Further objects and advantages, and a better understanding of the present invention will be had by a reference to the following detailed description taken in conjunction with the accompanying drawings wherein.

DETAILED DESCRIPTION OF THE PREFERRED EMBODIMENT

Figure 1:
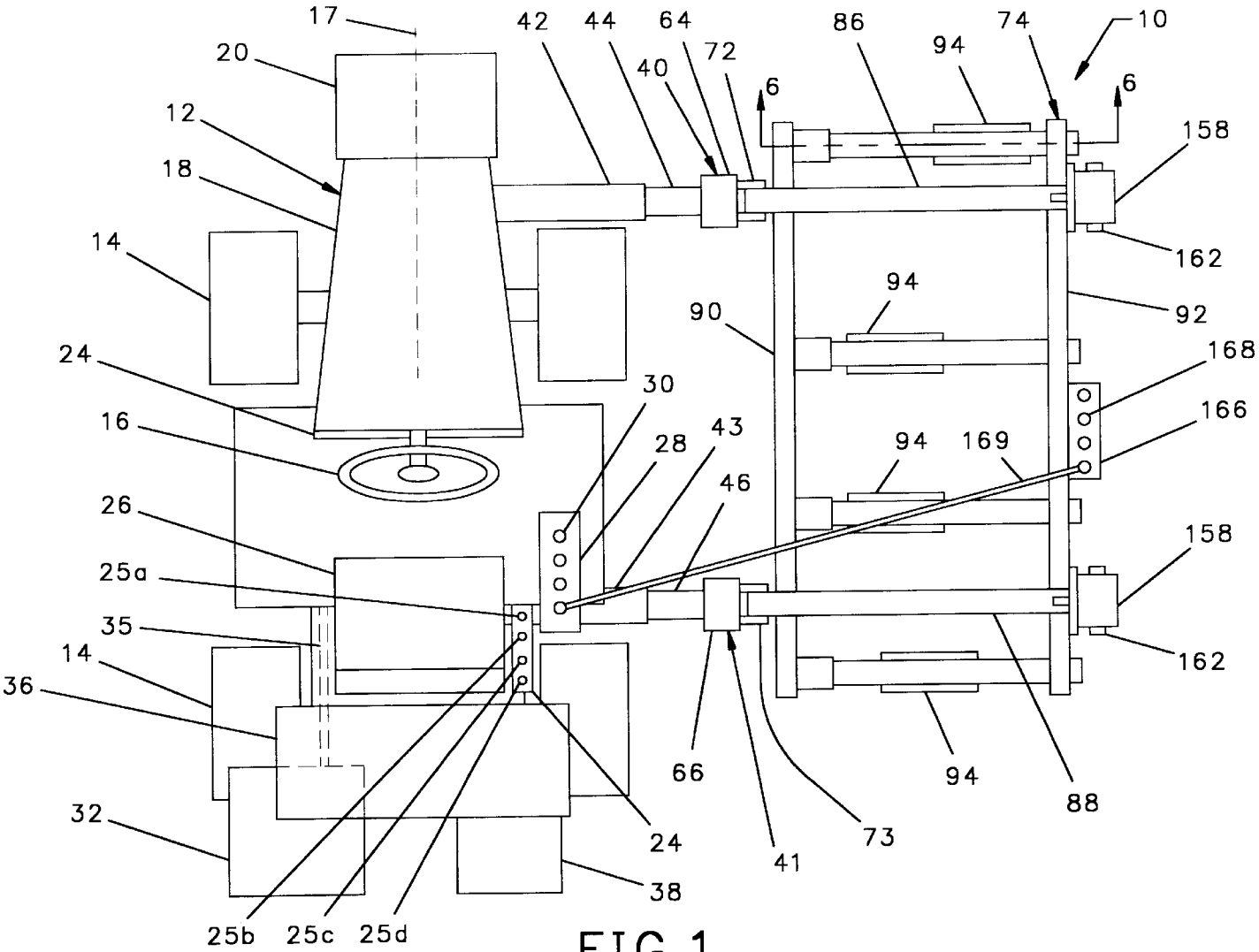
FIG. 1 is a top view of a doweling hole drilling machine in accordance with the present invention with the frame in the lowered position so as to extend horizontally from the side of the tractor.
Figure 2:
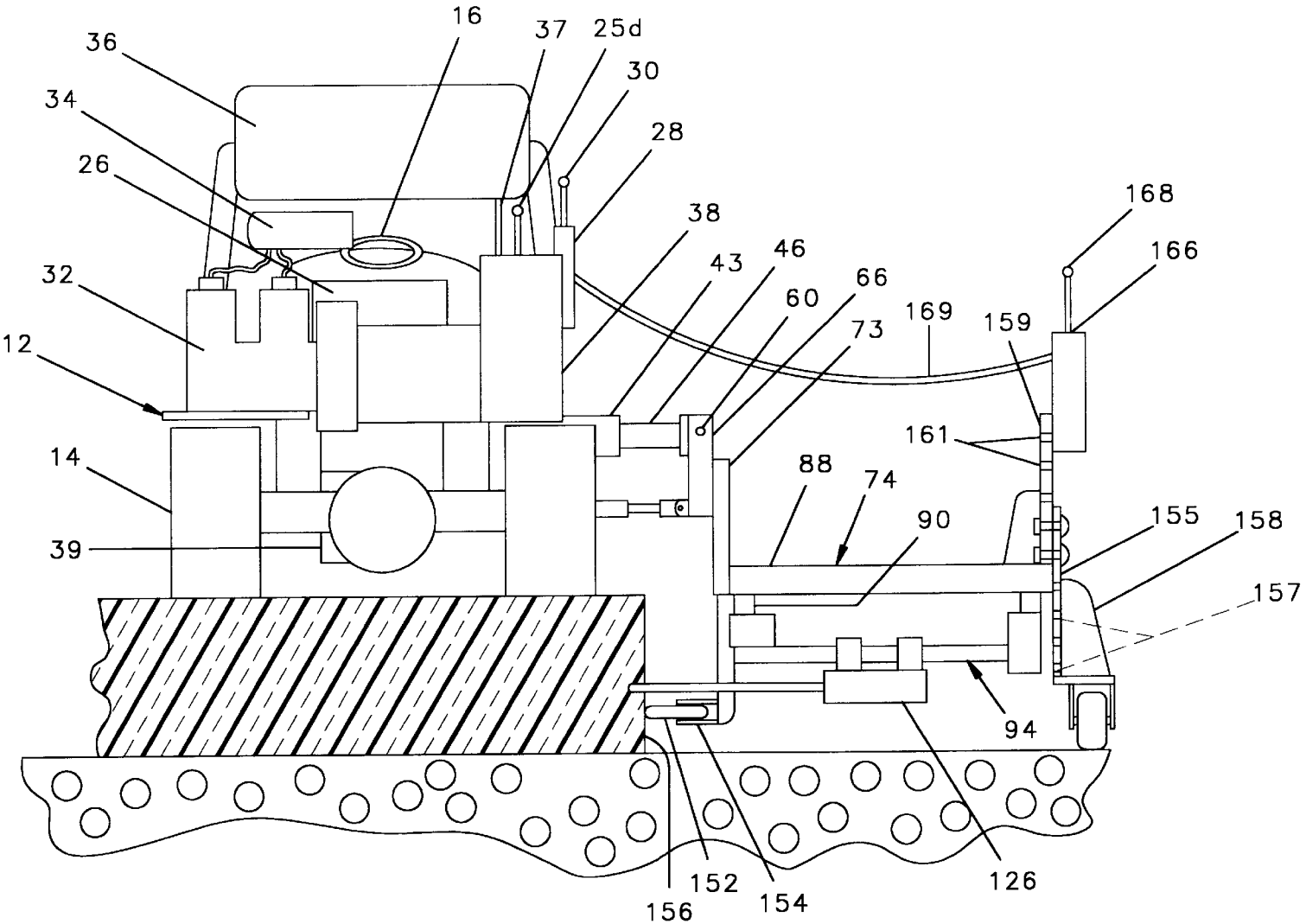
FIG. 2 is a rear view of the machine shown in FIG. 1 positioned on a slab of concrete with the drilling machines oriented to drill into the side of a slab.

Referring to FIGS. 1 and 2, a doweling hole drilling machine 10 in accordance with the invention includes a tractor 12 having wheels 14—14 symmetrically positioned around a longitudinal axis 17, a steering wheel 16, a motor 18 for driving the wheels 14, and a hydraulic pump and storage reservoir 20. The tractor further has a first control panel 24 upon which are mounted a plurality of hydraulic valves 25*a*–25*d* with associated control levers, a seat 26, and a second side mounted control panel 28 on which are mounted a second plurality of lever operating valves 30—30 for controlling the flow of hydraulic fluid pressurized by the motor 18 and pump 20 to operate the functions of the drilling assembly as further described below. Behind the seat 26 and positioned above the rear wheels 14 is an air compressor 32 which draws air through a filter 34, and compressed air from the compressor 32 is stored in an elevated storage tank 36 with an output line 37. opposite the compressor 32 is an oil cooler 38. I have found that the model 4010 Ditch Witch tractor manufactured by Charles Machine Works, Inc. is particularly suited for use with the present invention because it has a transmission for a trench drive which can receive a chain drive 35 to drive the air compressor 32 with the motor 18. Also, this model tractor has a hydraulic drive 39 to the wheels 14 which can be modified to permit the tractor 12 to move slowly forward or rearward which is useful in positioning the machine prior to drilling.

Extending horizontally from the lower frame of the tractor 12, perpendicular to the longitudinal axis 17 thereof, are first and second lateral adjusting assemblies 40, 41, respectively, which are similar to each other. The forward assembly 40 is depicted in detail in FIGS. 4 and 5, and some features portrayed in these figures are not visible in other figures. Each of the assemblies 40, 41 includes a sleeve 42, 43, respectively, welded securely to the bottom of the frame of the tractor 12, and slidably received within each of the sleeves 42, 43, are adjusting cylinders 44, 46, respectively.

Figure 4:
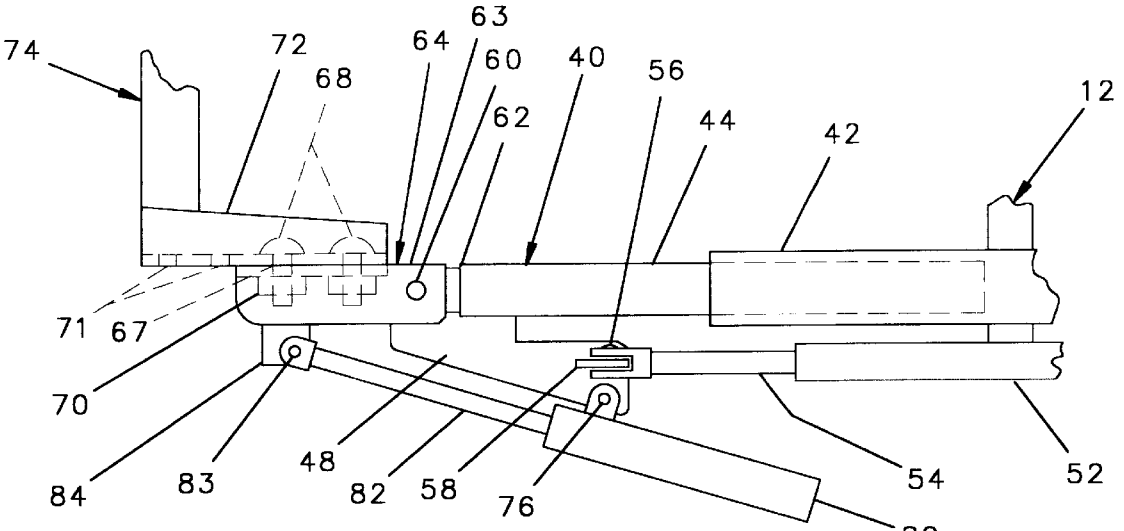
FIG. 4 is an enlarged fragmentary view of the lateral horizontal adjustment assembly with the frame in the elevated position.
Figure 5:
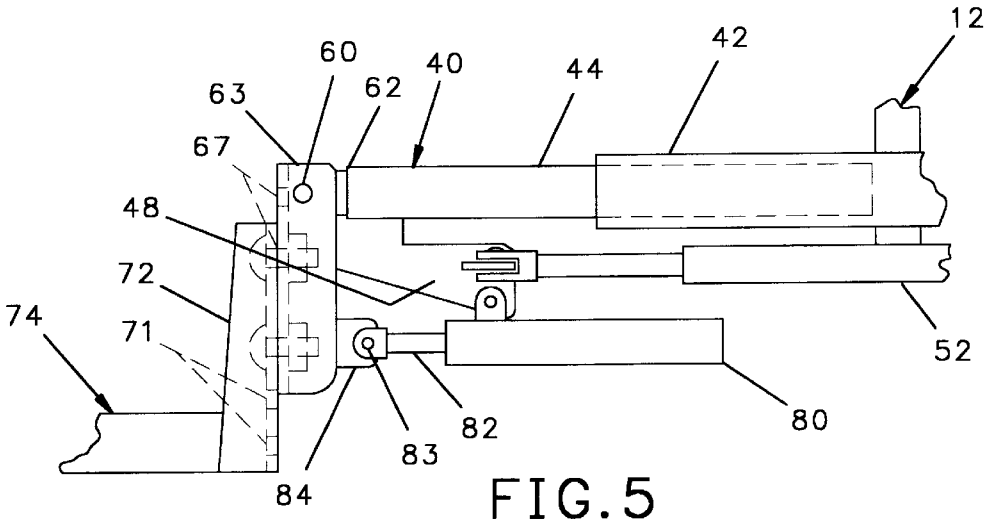
FIG. 5 is an enlarged fragmentary view of the lateral horizontal adjustment assembly for the machine in FIG. 1 with the frame in the lowered position.

Fixedly welded to the distal ends of each cylinder 44, 46, is an arm 48, visible only in FIGS. 4 and 5. Each arm 48 extends rearwardly from the distal end of the associated cylinder 44, and each arm 48 is spaced from the cylinder body 44 so as not to interfere with the associated sleeve 42 as the cylinder slides therein.

Mounted on the tractor 12 below the sleeve 42 and oriented to operate parallel to the movement of the cylinder 44, 42 is a first hydraulic cylinder 52, having a shaft 54, the distal end of which is pivotally attached by a pin 56 through an eye bolt 58 on the arm 48. The extension of the shaft 54 from the cylinder 52 will force the arm 48 away from the sleeve 42, thereby withdrawing the cylinder 44 outward from the sleeve 42. Conversely, the retraction of the shaft 54 within the hydraulic cylinder 52 will draw the arm 48 inward toward the tractor 12, and the cylinder 44 will slide within the sleeve 42. The flow of hydraulic fluid to the cylinders 44 is controlled by two of the valves 25*a*, 25*b* and their associated levers. It has been found that to coordinate the movement of the two first cylinders 52 so that the frame attached thereto does not twist, it is desirable to have separate control valves 25*a*, 25*b*, one for each cylinder 52.

Pivotally attached by a pin 60 to the forward end 62 of arm 48 is one end 63 of a first mounting bracket 64, and, as shown in FIG. 1, pivotally attached to the rearward arm is a second mounting bracket 66. Each of the brackets 64, 66 has a plurality of holes 67—67 along the length thereof, not shown, and removably attached to the brackets 64, 66 by bolts 68 and -nuts 70, are first and second mounting arms 72, 73, respectively, for mounting a drill frame 74. The arms 72, 73 each have a plurality of holes 71-71 therein such that the arms 72, 73 may be assembled to the brackets 64, 66 at any of a number of elevations, and the drill frame 74 may be positioned at any of a number of corresponding elevations.

Figure 3:
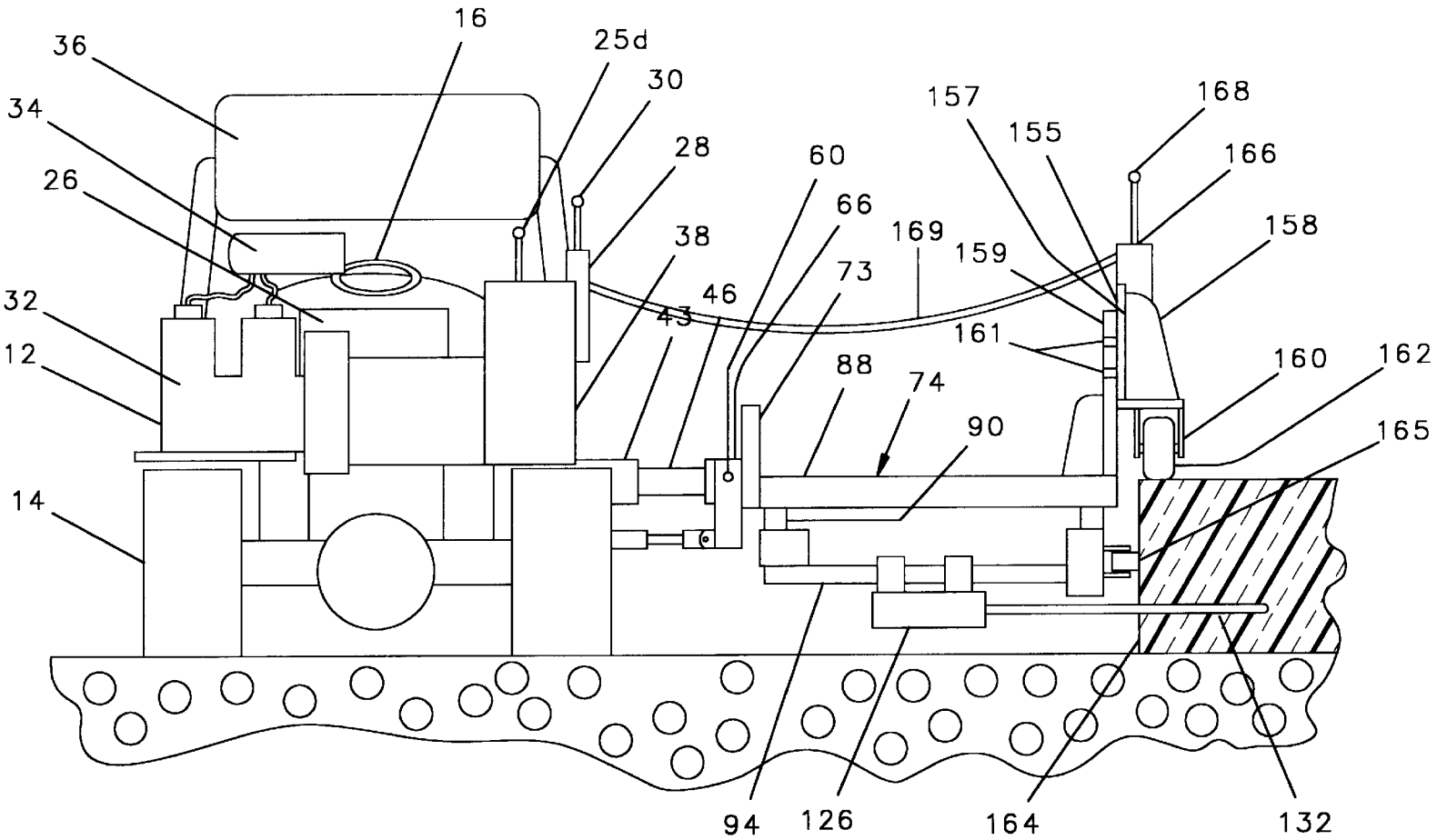
FIG. 3 is a rear view of the machine shown in FIG. 1 positioned on a grade with the drilling machines oriented to drilling into the side of an adjacent concrete slab.

Referring further to FIGS. 4 and 5, pivotally attached by a pin 76 through the lower end of the arm 48 is a second hydraulic cylinder 80 having a shaft 82 extending therefrom, the distal end of which is pivotally attached by a pin 83 to a second end 84 of the bracket 64. The extension of the rod 82 from the second cylinder 80 will force the second end 84 of the bracket 64 away from the arm 48 and move the frame 74 into an elevated position as shown in FIG. 4. Conversely, the retraction of the shaft 82 into the second cylinder 80 will cause the second end 84 of the bracket 64 to be drawn toward the arm 48 and cause the frame 74 to be lowered into a horizontal position as shown in FIGS. 1, 2 and 3. Like the first cylinders, the movement of the second cylinders 80 is -controlled by a valve 25*c* and associated lever on the first control panel 24 of the tractor 12.

Referring further to FIGS. 1 and 2, the frame 74 includes first and second primary frame members 86, 88, each of which is welded perpendicular to the lower ends of the arms 72, 73, respectively, as seen in FIG. 2. Extending across the inner ends of the frame member 86, 88 is a first transverse frame member 90, and extending across the outer ends of the frame members 86, 88 is a second transverse frame member 92. When the frame 74 is positioned horizontally as seen in FIGS. 1 and 2, below the frame 74 and extending between the first and second transverse frame members 90, 92 are a plurality of elongate drill assemblies 94.

Figure 6:
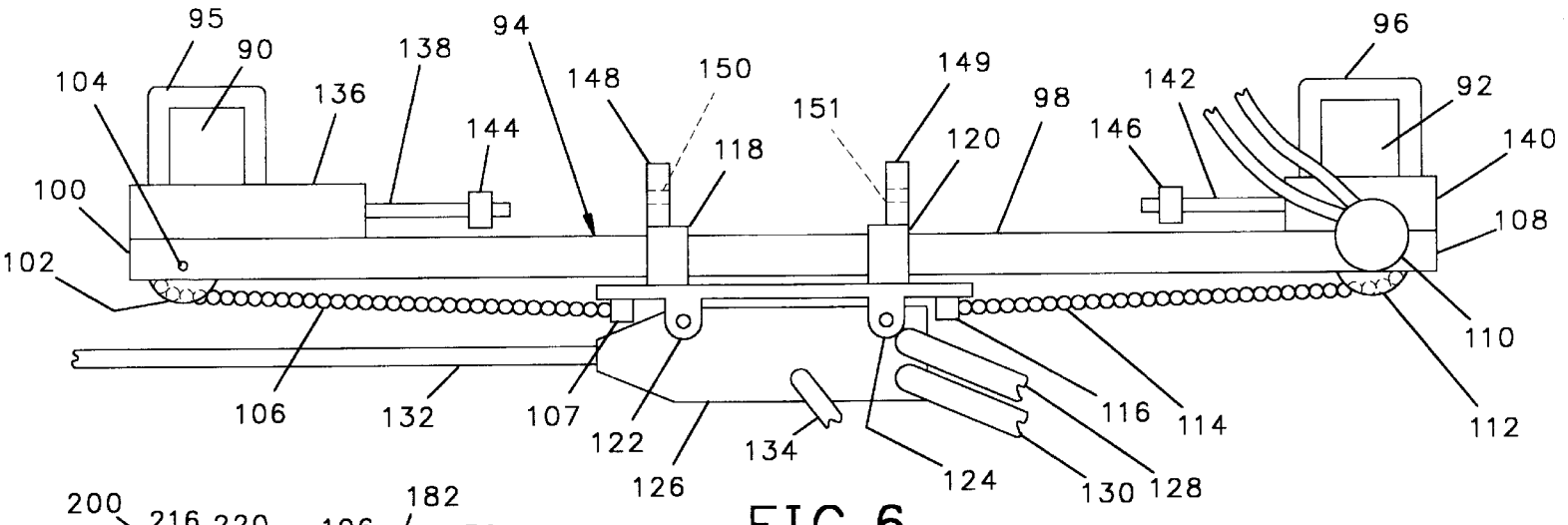
FIG. 6 is an enlarged view of a drill assembly of the machine shown in FIG. 1.

Referring to FIG. 6, which depicts a drill assembly oriented parallel to the ground as shown in FIGS. 1 and 2, each drill assembly 94 is removably attachable to the transverse frame members 90, 92 by removable U-bolts 95, 96, such that the drill assemblies 94 can be positioned where desired along the length of the transverse frame members 90, 92. Each drill assembly 94 includes a hollow square beam guide bar 98 at one end 100 of which has a chain sprocket 102 pivotally mounted on a pin 104 extending through the walls of the bar 98. A chain 106 is wrapped around the sprocket 102 with one end 107 of the chain extending below the guide bar 98, and the length of the chain 106 extending through the center of the guide bar 98. At the second end 108 of the guide bar 98 is a hydraulic motor 110 which drives a second sprocket 112. The chain 106 which extends through the guide bar 98 from the first sprocket 102 is wrapped around the second sprocket 112 with the two ends 107, 114 thereof connected to opposing ends of a moveable car 116.

The car 116 has first and second slidable guide straps 118, 120, respectively, which wrap around the guide bar 98 for slideable movement therealong, such that rotation of the motor 110 will cause the chain 106 and sprockets 102, 112 to move the car 116 along the guide bar 98. Attached by brackets 122, 124, to the car 116 is a hydraulically operated drilling machine 126 having a hydraulic fluid input line 128, a hydraulic fluid output line 130, and a compressed air input line 134. Drill assemblies as described herein are manufactured by Woodings Doweling Technologies, Inc. of Mars, Pa., and sold as a KS-10 chainfeed unit bearing part number 972-826-08.

The drilling machine 126 is of a type commonly known in the art for drilling into concrete and receives a hollow drill bit 132. Such machines 126 rotate the drill bit 132 while hammering against the end of the drill bit to thereby maximize the drilling. During the drilling, compressed air from the compressor 32 and tank 36 is directed through line 37 to a valve 30 on the control panel 28, to input line 134 and is expelled through the hollow drill bit 132 to thereby blow drilling cuttings out of the hole being drilled. A suitable drill for use in the present invention is also manufactured by Woodings Doweling Technologies, Inc.

Attached to an upper portion of the mounting 136 above the first end 100 of the guide bar 98 is a first adjusting bolt 138 which extends parallel to the length of the guide bar 98 and toward the car 116, and attached to the mounting 140 above the second end 108 of the guide bar 98 is an opposing second adjusting bolt 142 which also extends parallel to the length of the guide bar, and toward the car 116. On each of the adjusting bolts 138, 142, respectively, are first and second nuts 144, 146, respectively. Extending vertically from the upper surface of each guide strap 118, 120 is a transverse flange 148, 149, respectively, each of which has a transverse hole 150, 151, therein sized to slideably receive the shaft of the associated guide bolt 138, 142, respectively, but not the nut 144, 146 thereon. The hole 150 in the first flange 148 is aligned to receive the end of the first bolt 138 such that movement of the car 116 toward the first end 100 will be limited by the contact of the first nut 144 against the first flange 148. Similarly, the hole 151 in the second flange 149 is aligned to receive the end of the second bolt 142 such that movement of the car 116 toward the second end 108 will be limited by the contact of the second nut 146 against the second flange 149.

Referring to FIG. 2, the frame 74 further includes a first set of guide wheels 152 mounted on a vertical axle supported by a bracket 154 such that each guide wheel 154 will roll against a side surface 156 of a concrete slab in which doweling holes are being drilled. In the preferred embodiment there are two guide wheels 152, one positioned below each of the horizontal adjusting assemblies 40, 41 such that they are not visible in FIG. 1.

At the distal ends of each of the frame members 86, 88, respectively, are a second set of guide wheel assemblies 158, each of which includes a bracket 160 for mounting a wheel 162 for rotation about a horizontal axis. Each guide wheel assembly 158 has a mounting plate 155 having a plurality of holes 157 therein, and the mounting plate 155 is attached by a plurality of bolts and associated nuts, not shown, to a retaining member 159 which also has a complementary plurality of holes 161 therein. The holes 157 of the mounting plate 155 and the holes 161 of the retaining member 159 are spaced such that the wheel assembly may be mounted at any of a plurality of elevations relative to the retaining member 159. The second set of wheel assemblies 158 are bolted to the associated mounting members 159 at the appropriate elevation above the drills 132 such that the wheels 162 will roll on grade when the machine is positioned on the slab as shown in FIG. 2 or will roll on top of the slab when the machine is positioned on grade as shown in FIG. 3.

Removably attached by bolts and nuts, not shown, below the second set of guide wheels 162 are a third set of guide wheels 165 which revolve about vertical axes such that the third set of guide wheels can roll against a side of a concrete slab while the machine is operating on grade as shown in FIG. 3.

Referring to FIGS. 1 and 2, when the frame 74 is positioned horizontally, as shown, extending upwardly from the second transverse frame member 92 is a remote control panel 166 having a plurality of levers 168—168 which duplicates the levers controlling the valves 30—30 on the second control panel 28 with each lever 168 connected by a push pull cable, only one of which 169 is shown, to an associated lever 30, thereby providing dual controls for the power operated devices mounted on the frame 74. Specifically, the valves 30—30 are operated from either the second control panel 28 or the remote panel 166 to direct hydraulic fluid to the drilling machines 126 and the hydraulic motors 110 to control the drilling of dowel holes into a side of a slab of concrete.

Figure 8:
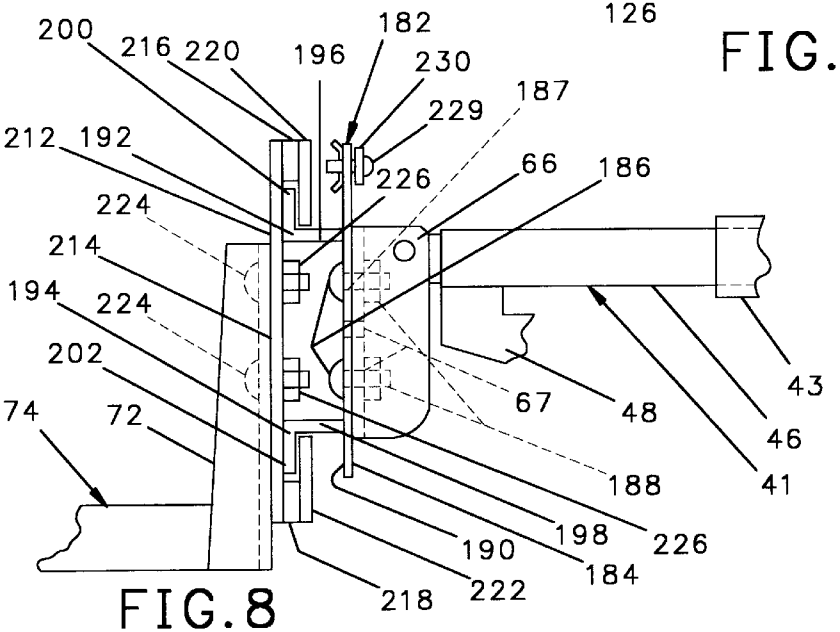
FIG. 8 is a fragmentary enlargement of a lateral adjusting assembly showing portions which also longitudinally adjust the frame.
Figure 7:
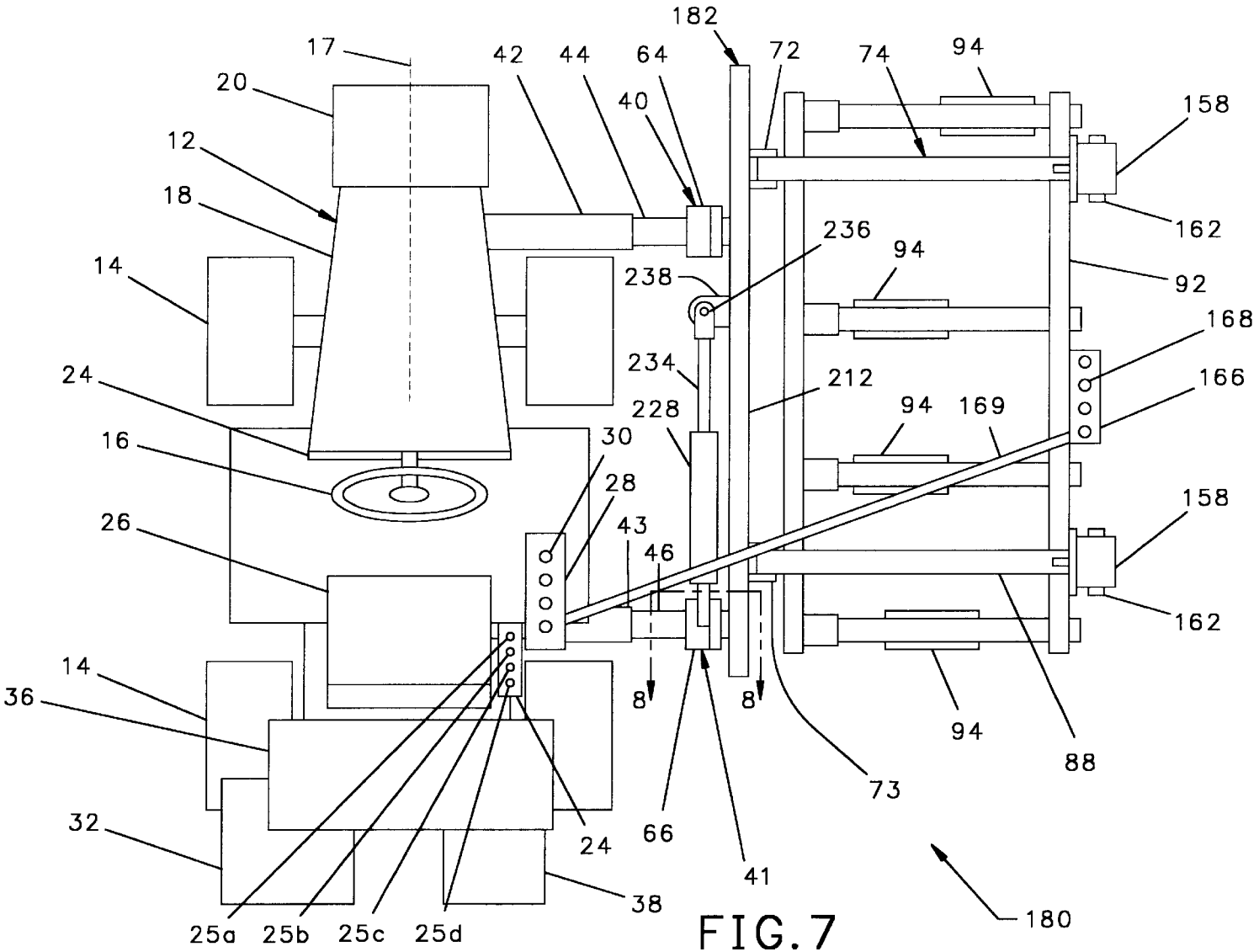
FIG. 7 is a top view of a second embodiment of a doweling hole drilling machine which has a longitudinally adjustable frame.

Referring to FIGS. 7 and 8, which depict a second embodiment of the present invention in which elements which are like those of the first embodiment bear like indicia numbers, a doweling hole drilling machine 180 includes a tractor 12, lateral adjusting assemblies 40, 41, and a drill frame 74 including a plurality of drill assemblies 94 similar to the first embodiment. Positioned between the bracket 64, 66 of the adjusting assemblies 40, 41 and the first and second mounting arms 72, 73, respectively, of the drill frame 74 is a longitudinal adjusting assembly 182.

Referring to FIG. 8 in which a fragment of the rear adjusting assembly 41 is depicted, a slide plate 184 is secured to the mounting bracket 66 by a plurality of bolts 186—186 which extend through the holes, 67—67, in the mounting bracket 66 and through a complementarily positioned set of holes, 187—187, in the slide plate 184, and are retained therein by complementary nuts 188—188. Extending from the outer surface 190 of the slide plate 184 are first and second angle iron slide members 192, 194 positioned with their first legs 196, 198, respectively, parallel to each other, and the second legs 200, 202, respectively, extending in opposing directions from each other. The inner surfaces of the two second legs 200, 202 are, therefore, substantially coplanar to each other as are the outer surfaces thereof.

Referring to FIGS. 7 and 8, extending across the two slide plates 184 is an elongate slide bar 212. Attached along one side of the upper and lower edges of the slide bar 212 are elongate upper and lower lips 220, 222, respectively, which are offset from the surface of the slide bar 212 by first and second spacers 216, 218, respectively. As can be seen, the slide bar 212, the spacers 216, 218 and lip members 220, 222, form a track which is slidable across the slide members 192, 194 on the mounting bracket 64, 66. The first and second mounting arms 72, 73 of the frame 74 are adjustably attached to the slide bar 212 by a plurality of bolts 224 and nuts 226, which extend through a plurality of holes in the mounting arms 72, 73 and complementarily positioned holes, not shown, in the slide bar 212.

A third hydraulic cylinder 228 has one end thereof mounted to the upper end of one of the slide plates 184 by any appropriate means which is a pin 229 extending through the slide plate and an eye-bolt 230 attached to end of the cylinder 228. Extending from the opposite end of the cylinder 228 is a longitudinally movable rod 234, the distal end of which is connected by a pin 236 to an eye-bolt 238 mounted on the slide bar 212. The operation of the hydraulic cylinder 228 is controlled by one of the valve levers **25*d* on the first control panel 24 of the tractor 12. When the rod 234 is extended from the cylinder 228, the slide bar 212 is moved forwardly, and the drill frame 74 which is mounted on the slide bar 212 is thereby shifted forwardly relative to the tractor 12. Conversely, when the rod 234 is withdrawn into the cylinder 228, the slide bar 212 is moved rearwardly, thereby moving the drill frame 74 rearward relative to the tractor 12. Preferably, the valve 25*d* is of the type for which the gates through which fluid is admitted to both sides of the piston in the cylinder 228 are closed when the valve is not directing fluid to the cylinder, thereby locking the cylinder 228 and the frame 74** against longitudinal movement.

Operation

To operate a doweling hole drilling machine in accordance with the present invention, the machine 10 is driven to the site with the drilling frame 74 elevated as shown in FIG. 4 so as not to obstruct traffic. To operate the machine for drilling doweling holes into the side of a slab of concrete from a position above the slab, as shown in FIG. 2, the tractor is positioned on the slab with the longitudinal axis 17 thereof parallel to the side 156 of the concrete slab into which the doweling holes are to be drilled. The U-bolts 95, 96 on the various drill assemblies 94 are removed or adjusted as needed to obtain the desired spacing between the drill assemblies 94. It should be appreciated that the direction in which the drilling machines 126 face can be reversed by removing the U-bolts 95, 96 altogether and turning each of the drilling assemblies 94 end to end so as to face in the opposite direction, then reattaching the U-bolts 95, 96. The nuts 144, 146 are positioned along the guide bolts 138, 142, respectively, to fix the desired travel length for the drilling machines 126. The elevation of the assemblies 158 for the second set of wheels 162 should also be adjusted as needed. Thereafter, the operator can open the appropriate valve **25*c* to withdraw the shafts 82 within the second cylinder 80 thereby lowering the frame 74 into the horizontal position shown in FIGS. 1 and 2**.

Next, the operator can adjust the valves **25*a*, 25*b* controlling the first cylinders 52 to extend or retract the first rod 54 such that the frame 74 is positioned with the guide wheels 152 abutting the side 156 of the concrete slab. The valves 30—30 can then be operated to direct fluid to run both the drilling machines 126 and the hydraulic motors 110 to drill a plurality of doweling holes into the concrete slab. During the drilling process, compressed air from the tank 36 and the compressor 32 will be expelled through the drills 132** to blow cuttings out of the holes being drilled.

After the first set of holes has been drilled, the operator can use the appropriate valves 30—30 to reverse the flow of hydraulic fluid to the motors 110 to thereby withdraw the drills 132 from the newly bored holes. The operator may then control the valves **25*a*, 25*b* to extend the rods 54 from the first cylinders 52 and move the frame 74 away from the slab, after which the tractor can be moved to a new location and the drilling process can be repeated. Should the operator desire to watch the drilling operation, he can also dismount the tractor and control the drilling operation from the remote control panel 166**.

Should the operator desire to drill doweling holes while the tractor 12 is positioned on grade, as shown in FIG. 3, the nuts 70 and bolts 68 which retain the first and second mounting arms 72, 73 to the bracket 64, 66 may be removed and the mounting arms 72, 73 repositioned on the brackets 64, 66 so that the elevation of the drill frame 74 will be at the proper elevation to drill doweling holes in the side of the slab 164. The operator should also adjust the elevation of the guide wheel assemblies 158 on the mounting plates 155 upwardly or downwardly to thereby adjust the distance between the bottom of the guide wheels 162 and the center of the drill 132 such that the drill 132 will bore at the proper elevation into the side 164 of the slab. Also, the U-bolts 95, 96 which retain the drill assemblies 94 to the frame 76 must be removed and the assemblies 94 reversed such that the drills 126 will drill away from the tractor 12 as shown in FIG. 3. In this configuration, the operator will use the valves **25*a*, 25*b* to extend the frame 24 outward until the third set of guide wheels 165 abut against the surface of the concrete slab 164** after which the operator will commence the drilling operation as described above.

A doweling hole drilling machine 180, in accordance with the second embodiment includes the longitudinal adjusting assembly 182 such that the drilling frame 74 may be adjusted forwardly or rearwardly relative to the tractor 12. This embodiment is particularly desirable for drilling doweling holes after a portion of a concrete pavement has been removed and prior to pouring a concrete patch because the specifications which relate to the pouring of concrete patches in pavement generally require that doweling holes be spaced on 12 inch centers rather than 24 or 30 inch centers. A machine which has been set to drill hole with 24 inch centers may then be used to drill doweling holes with 12 inch centers by drilling a first set of holes with 24 inch centers and thereafter forwardly or rearwardly adjusting the drilling frame 74 and drilling a second set of holes between the first set of holes.

Alternative Embodiments

Figure 9:
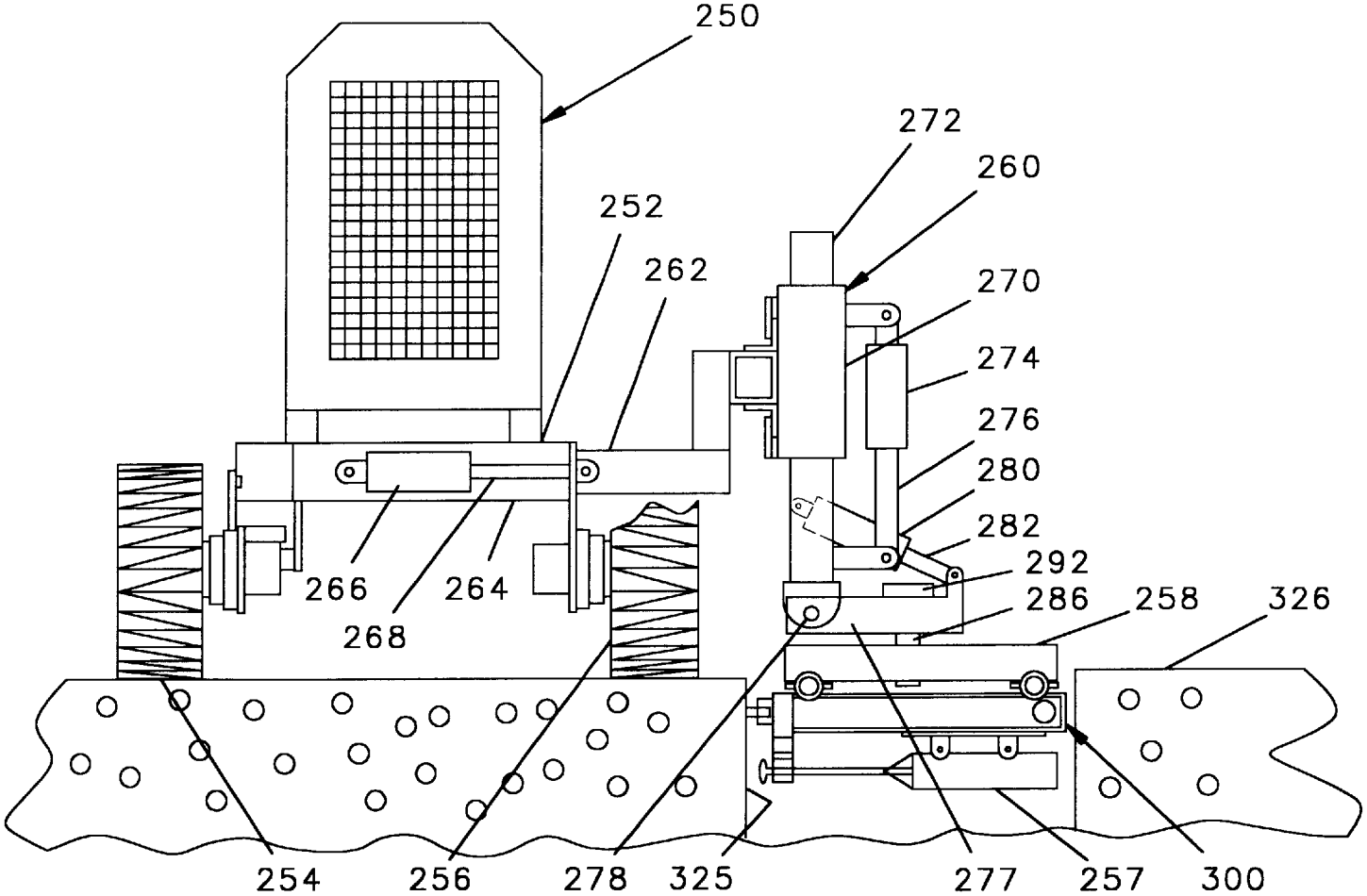
FIG. 9 is an end view of an alternate embodiment of a control assembly for connecting the drill frame to the tractor.

It should be appreciated that there are many alternate configurations for the controls which connect to the tractor to operate the frame, and an alternate embodiment is depicted in FIG. 9. In this embodiment, a tractor 250 has a frame 252 supported by a set of wheels, two of which 254, 256, are shown. In this embodiment, the drill frame 258 has a plurality of drills 257 mounted thereon and is retained to the tractor 250 by an assembly 260 which includes a support arm 262 slidable within a support guide 264 for horizontal movement toward and away from the tractor in a direction perpendicular to the longitudinal axis of the tractor. A hydraulic cylinder 266 mounted on the tractor frame 252 has an extendable piston arm 268 attached to the assembly 260 for moving the support arm 262 within the guide 264.

The assembly 260 further includes a vertically oriented guide 270 secured to the distal end of the support arm 262 and a slide bar 272 vertically slidable within the guide 270. The slide bar 272 is moved by a second piston 274 and piston arm 276 to thereby provide vertical movement of the drill frame 258. The frame 258 is mounted to a pivoting member 277 to the vertical slide bar 272 which is pivotally attached by one or more pins 278 so that it is movable from a horizontal orientation, as depicted in FIG. 9, to a vertical orientation similar to that depicted in FIG. 4, by the movement of a third hydraulic cylinder 280 and an associated piston arm 282.

In this embodiment, the frame 258 is mounted to a pivoting member 277 on a pin 286 extending therethrough, and the distal end of which is welded to a member centrally located in the drill frame 258 with the axis of the pin 286 oriented perpendicular to a plane defined by the axes of the plurality of drills 257. In this embodiment, a motor 292 on the pivoting member 277 rotates the pin 286 to thereby rotate the drill frame 258 through 180 degrees such that the drills 257 may be directed to drill towards the tractor, as depicted in FIG. 9, or away from the tractor, as shown in FIG. 3.

Figure 10:
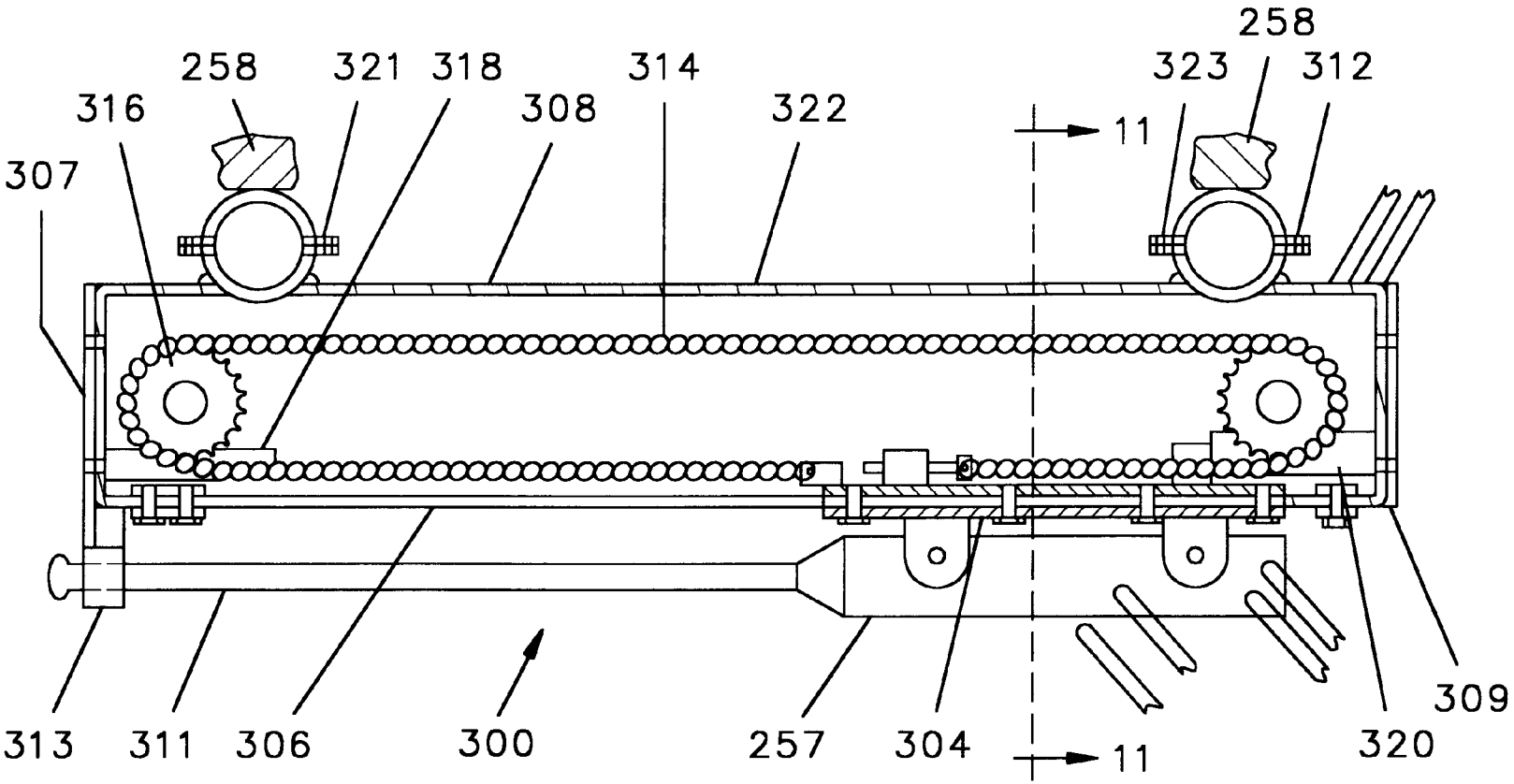
FIG. 10 is a cross-sectional view of an alternate embodiment of a drill assembly.
Figure 11:
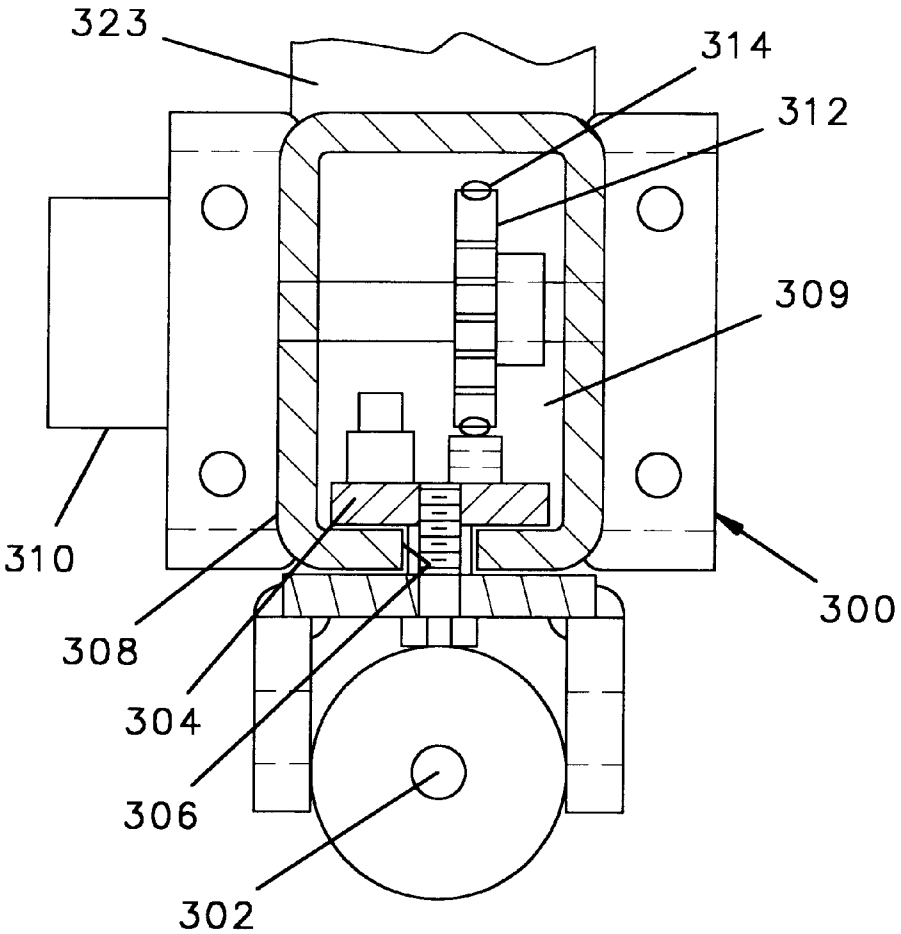
FIG. 11 is an enlarged cross-sectional view of the drill assembly shown in FIG. 10 taken through line 11-11 thereof.

Referring to FIGS. 10 and 11, in this alternative embodiment of a drill assembly 300, the drill 257 is mounted on a slide 304 for slidable movement within a slot 306 extending along the bottom of a length of box tubing 308. The tubing 308 has caps 307, 309 at the ends thereof and one of the caps 307 has a downwardly extending flange 313 with a hole therein through which the drill steel 311 extends. The slide 304 and the drill 257 mounted thereon are movable between the sides of the slot 306 by a motor 310 drivingly connected to a drive sprocket 312 at one end of the box tubing 308 and a chain 314 which also extends around an idler 316 at the opposite end thereof. Guides 318, 320 are positioned within the box tubing 308 to define the ends for the movement of the slide 304 along the slot 306, and the box tubing 308 is secured to the drill frame 258 by welded plates 321, 323 positioned anywhere along the upper surface 322 of the assembly 300.

Referring to FIG. 9, the drill assembly 300 does not have to be attached to the frame by its ends, as was the case with the assembly depicted in FIG. 6, and, therefore, the assembly 300 can be made shorter in length so as to drill doweling holes in a three foot wide repair cut 325 in pavement 326. It should be appreciated that a three foot cut is the standard minimum width for a repair cut in the pavement of a road, and except for very small drill units of the type consisting of a single wheel mounted drill, the drilling assemblies of existing drilling machines are longer than three feet and are unable to fit within such a cut.

Figure 12:
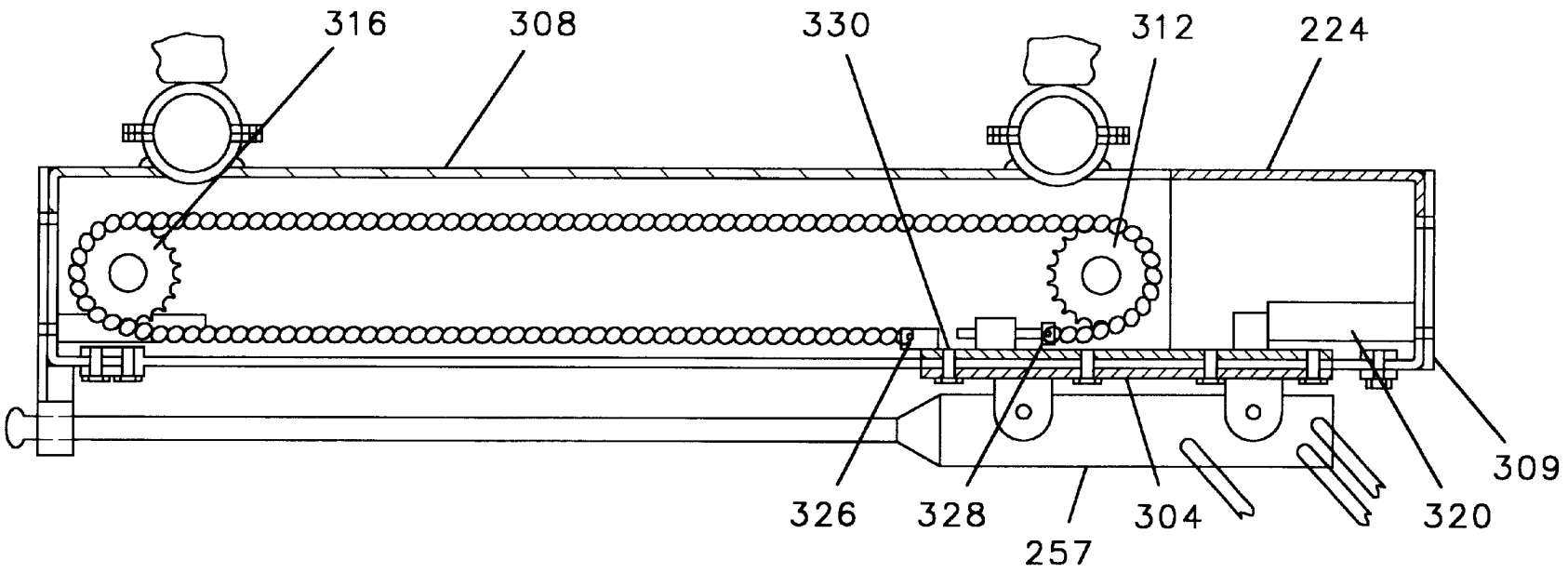
FIG. 12 is a cross-sectional view of the drill assembly shown in FIG. 10 with an extension added thereto.

Referring to FIG. 12, the standard depth required for a dowel hole in a road is 12 inches, and a drill assembly 300, as depicted in FIGS. 10 and 11 having an overall length of less than 3 feet is capable of drilling a 12 inch deep doweling hole. Nonetheless, under certain circumstances, such as for airport runways, deeper doweling holes may be required. To accommodate the deeper holes, an extension 224 can be attached to the drill assembly 300 to provide a longer enclosure, and an extension 324 of the slot 306 to thereby allow a longer travel length of the slide 304. The second guide 320 which defines one end of the travel length of the slide 304 is welded to the cap 309 which is removed from the tubing 308 and attached to the extension 324 thereby lengthening the travel of the slide by the length of the extension 324.

As can be seen, the slide 304 has attachment eyes 326, 328 which are in near proximity to each other and positioned near the forward end 330 of the slide 304 such that when the drill 257 is in the retracted position, as shown in FIG. 12, the distal end thereof extends into the extension 324. The positioning of the eyes 326, 328 in near proximity to one another, therefore, permits the addition of the extension 324, without altering the positions of the motor 310, the drive sprocket 312 or the idler 316. The same machine that is usable to drill doweling holes within a three foot wide repair cut is also usable to drill doweling holes in the pavement of airport runways.

As has been previously explained, the most commonly used prior art doweling hole drilling machines require a two man crew for their operation. The device is adapted for attachment to a backhoe and to operate the equipment the tractor supporting the backhoe must be positioned perpendicular to the side of the concrete pavement into which the doweling holes are to be bored. As a result, it is generally impossible for the tractor to be positioned on the pavement while a portion of the pavement is open to use by traffic. Furthermore, the process of drilling holes along the edge of a length of concrete roadway requires frequent repositioning of the air compressor and tractor and backhoe assembly which involves time consuming maneuvering by the operator. In contrast, a single operator is required to drill doweling holes using a machine in accordance with the present invention and the machine moves linearly along the length of an edge of pavement thereby requiring a minimum width of pavement and allowing a portion of existing pavement to be open to traffic. Also, the linear movement requires a minimum of time, which is further reduce because the drilling process is carried out by the operator using the controls 30 while he is positioned in the seat 26 of the tractor 12. A doweling machine in accordance with the present invention can drill nearly twice as many doweling holes over a period of time as can be drilled using prior known drilling equipment. Also, a machine in accordance with the present invention can be constructed so as to weigh less than 8,000 pounds so as to be usable on relatively fresh concrete, which has been allowed to set for only 24 hours.

There has, therefore, been disclosed a doweling hole drilling machine which provides the versatility of being able to drill a great number of doweling holes in a reduced amount of time while occupying a minimum amount of space on the concrete pavement, and operable by a single operator.

While the present invention has been described in connection with two embodiments thereof, it will be understood that many changes an modifications may be made without departing from the true spirit and scope of the present invention, and it is intended by the appended claims to cover all such changes and modifications which come within the true spirit and scope of the present invention.

What is claimed is:

1. A doweling hole drilling machine comprising in combination:

a vehicle for movement along a surface, said vehicle having a longitudinal axis;

a frame;

said frame hingeably connected to said vehicle for movement from a horizontal orientation to a vertical orientation about an axis parallel to said longitudinal axis of said vehicle;

a frame member on said frame, said frame member having a longitudinal axis;

said frame member maintained with said longitudinal axis thereof perpendicular to said longitudinal axis of said vehicle;

drilling means mounted on said frame member for drilling a hole the axis of which is substantially perpendicular to said longitudinal axis of said vehicle and the axis of said drill means being parallel to said surface when said frame is in said horizontal orientation; and drive means on said frame for axially moving said drilling means relative to said frame member.

2. A doweling hole drilling machine in accordance with claim 1 further comprising, a motor on said vehicle for independently propelling said vehicle across a surface.

3. A doweling hole drilling machine in accordance with claim 2 and further comprising:

an air compressor on said vehicle, means for driving said air compressor with said motor, means for directing compressed air from said air compressor to said drilling means, and said drilling means having means for expelling air into a hole being drilled.

4. A doweling hole drilling machine in accordance with claim 2 and further comprising longitudinal adjusting means for adjusting said frame relative to said vehicle in a direction parallel to said longitudinal axis of said vehicle.

5. A doweling hole drilling machine in accordance with claim 2 and further comprising:

first control means on said vehicle for controlling the operation of said drilling means, and second control means on said frame, said second control means operatively connected to said first control means for providing dual controls to said drilling means.

6. A doweling hole drilling machine in accordance with claim 2 and further comprising, adjusting means between said frame and said vehicle for moving said frame horizontally.

7. A doweling hole drilling machine in accordance with claim 6 and further comprising, power means connected to said adjusting means for applying force for moving said frame horizontally relative to said vehicle.

8. A doweling hole drilling machine in accordance with claim 7 wherein, said power means for moving said frame comprises first power means and second power means, said first power means being connected between said vehicle and said frame at a forward end of said frame, said second power means being connected between said vehicle and said frame at a rearward end of said frame, and control means for controlling said power means, said control means including means for independently controlling said first power means and said second power means for simultaneously moving said forward end and said rearward end of said frame.

9. A doweling hole drilling machine in accordance with claim 8 wherein said first power means and said second power means are hydraulic cylinders and each of said first and second power means are hydraulic cylinders and each of said first and second hydraulic cylinders are separately controllable.

10. A doweling hole drilling machine in accordance with claim 9 wherein said frame is horizontally adjustable with respect to said vehicle.

11. A doweling hole drilling machine in accordance with claim 2 further comprising, first power means for moving said frame between said horizontal orientation and said vertical orientation.

12. A doweling hole drilling machine in accordance with claim 2 and further comprising, adjusting means between said frame and said vehicle for moving said frame member in a direction perpendicular to said longitudinal axis of said vehicle and parallel to said surface.

13. A doweling hole drilling machine in accordance with claim 12 and further comprising, power means connected to said adjusting means for applying force for moving said frame relative to said vehicle in a direction perpendicular to said longitudinal axis.

14. A doweling hole drilling machine in accordance with claim 2 and further comprising, first control means on said vehicle for controlling the operation of said drive means, and second control means on said frame, said second control means operatively connected to said first control means for providing dual controls to said drive means.

15. A doweling hole drilling machine in accordance with claim 2 and further comprising:

said frame having an outer end, a wheel on a wheel mounting, said wheel mounting attached to said outer end of said frame, and the height of said wheel on said mounting being adjustable for vertically adjusting said outer end of said frame when said frame is horizontally oriented.

16. A doweling hole drilling machine in accordance with claim 2 wherein the elevation of said frame member relative to said surface is adjustable.

17. A doweling hole drilling machine comprising in combination:

a vehicle for moving along a surface, said vehicle having a longitudinal axis ;

a frame;

a frame member on said frame, said frame member having a longitudinal axis, said frame member maintained with said longitudinal axis thereof perpendicular to said longitudinal axis of said vehicle, drilling means mounted on said frame member for drilling a hole the axis of which is substantially parallel to said surface and perpendicular to said longitudinal axis of said vehicle;

drive means on said frame for axially moving said drilling means relative to said frame member; and adjusting means between said frame and said vehicle for moving said frame member in a direction parallel to said longitudinal axis of said vehicle.

18. A doweling hole drilling machine comprising in combination, a vehicle having a longitudinal axis;

a frame having an outer end;

said frame hingeably connected to said vehicle for movement from a horizontal orientation to a vertical orientation;

drilling means mounted on said frame for drilling a hole the axis of which is substantially perpendicular to said longitudinal axis of said vehicle;

drive means on said frame for axially moving said drilling means relative to said frame;

a wheel on a wheel mounting;

said wheel mounting attached to said outer end of said frame; and the height of said wheel on said mounting being adjustable for vertically adjusting said outer end of said frame when said frame is horizontally oriented.

19. A doweling hole drilling machine comprising in combination, a vehicle for movement along a surface;

a motor on said vehicle for independently propelling said vehicle across a surface;

a frame;

said frame hingeably connected to said vehicle for movement from a horizontal orientation to a vertical orientation;

a frame member on said frame, said frame member having a longitudinal axis;

drilling means mounted on said frame member for drilling a hole, said drilling means having a longitudinal axis parallel to said surface when said frame is in said horizontal orientation;

drive means on said frame for axially moving said drilling means relative to said frame member, and adjusting means between said frame and said vehicle for moving said frame member in a direction parallel to said longitudinal axis of said frame member.

20. A doweling hole drilling machine comprising in combination:

a vehicle for movement along a surface, said vehicle having a longitudinal axis;

a motor on said vehicle for independently propelling said vehicle;

a frame;

said frame hingeably connected to said vehicle for movement from a horizontal orientation to a vertical orientation about an axis parallel to said longitudinal axis of said vehicle;

a frame member on said frame, said frame member having a longitudinal axis;

a drill frame member on said frame having a first end, a second end, and substantially planar upper surface extending from said first end to said second end, and having a longitudinal axis perpendicular to said longitudinal axis of said vehicle;

drilling means mounted on said drill frame member for drilling a hole of a given depth of the axis of which is substantially perpendicular to said longitudinal axis of said vehicle and the axis of said hole being substantially parallel to said surface when said frame is in said horizontal orientation;

drive means on said frame for axially moving said drilling means relative to said frame member;

first control means on said vehicle for controlling the operation of said drive means, second control means on said frame, said second control means operatively connected to said first control means for providing dual controls to said drive means;

an air compressor on said vehicle, means for driving said air compressor with said motor;

means for directing compressed air from said air compressor to said drilling means;

said drilling means having means for expelling air into a hole being drilled;

first control means on said vehicle for controlling the operation of said drilling means;

second control means on said frame, said second control means operatively connected to said first control means for providing dual controls to said drilling means;

first adjusting means between said frame and said vehicle for moving said frame horizontally parallel to said longitudinal axis of said vehicle;

second longitudinal adjusting means for adjusting said frame relative to said vehicle in a direction perpendicular to said longitudinal axis of said vehicle;

second adjusting means comprising:

first hydraulic cylinder power means being connected between said vehicle and said frame at a forward end of said frame;

second hydraulic cylinder power means being connected between said vehicle and said frame at a rearward end of said frame;

control means for controlling said power means, said control means including means for independently controlling said first power means and said second power means for simultaneously moving said forward end and said rearward end of said frame;

third power means for moving said frame between said horizontal orientation and said vertical orientation;

fourth power means connected to said first adjusting means for applying force for moving said frame relative to said vehicle in a direction parallel to said longitudinal axis;

said frame being vertically adjustable relative to said surface;

said frame having an outer end;

a wheel on a wheel mounting;

said wheel mounting attached to said outer end of said frame;

the height of said wheel on said mounting being adjustable for vertically adjusting said outer end of said frame when said frame is horizontally oriented;

means for reversing the orientation of said drill means from a first orientation wherein said drill means drills toward said vehicle to a second orientation wherein said drill means drills away from said vehicle;

fifth power means connected to said means for reversing the orientation of said drill means for automated reversal of said orientation of said drill means;

a removable extension means attachable to said frame for extending the length of travel of said slideable member by providing an extension of said slide means;

slide means on said drill frame member;

a slideable member on said drill frame member slidable in a direction generally perpendicular to said longitudinal axis, drill means mounted on said slideable member for drilling a hole the axis of which is substantially horizontal and perpendicular to said longitudinal axis of said vehicle;

chain drive means on said frame for moving said slide means, said chain drive means having a first chain end and a second chain end;

first connector means on said slideable member for connecting to said first chain end;

second connector means on said slideable member for connecting to said second chain end;

said first connector and said second connector being in close proximity to each other to maximize the length of movement of said slidable member; and connecting means between said drill frame member and said frame for retaining said drill frame member to said frame, said connecting means attaching to said drill frame member along said upper surface thereof.

* * * * *